United States Patent [19]

Nobue et al.

[11] 4,347,418

[45] Aug. 31, 1982

[54] HEAT-COOKING APPARATUS INCORPORATING INFRARED DETECTING SYSTEM

[75] Inventors: Tomotaka Nobue; Shigeru Kusunoki; Kazunari Nishii, all of Yamatokoriyama; Keijiro Mori, Nara, all of Japan

[73] Assignee: Matsushita Electric Industrial Co., Ltd., Kadoma, Japan

[21] Appl. No.: 125,249

[22] Filed: Feb. 27, 1980

[30] Foreign Application Priority Data

| | | | |
|---|---|---|---|
| Mar. 2, 1979 | [JP] | Japan | 54-24845 |
| Mar. 2, 1979 | [JP] | Japan | 54-24846 |
| Mar. 2, 1979 | [JP] | Japan | 54-24848 |
| Mar. 2, 1979 | [JP] | Japan | 54-24849 |
| Apr. 20, 1979 | [JP] | Japan | 54-54042[U] |
| May 23, 1979 | [JP] | Japan | 54-63670 |

[51] Int. Cl.[3] ..... H05B 9/06

[52] U.S. Cl. ..... 219/10.55 B; 219/10.55 F; 350/65; 250/341; 250/351; 250/338; 379/121

[58] Field of Search ..... 219/10.55 B, 10.55 R, 219/10.55 F, 10.55 M, 492; 250/341, 347, 351; 73/355 R, 339 R; 350/61, 65; 99/DIG. 14

[56] References Cited

U.S. PATENT DOCUMENTS

| | | | |
|---|---|---|---|
| 3,780,293 | 12/1973 | Flint | 73/355 R |
| 4,005,605 | 2/1977 | Michael | 73/355 R |
| 4,049,938 | 9/1977 | Ueno | 219/10.55 B |
| 4,063,458 | 12/1977 | Vogt et al. | 73/355 R |
| 4,115,678 | 9/1978 | Tachikawa et al. | 219/10.55 B |
| 4,191,876 | 3/1980 | Ohkubo et al. | 219/10.55 B |
| 4,237,366 | 12/1980 | Berg | 219/202 |
| 4,245,143 | 1/1981 | Miura et al. | 219/10.55 B |

FOREIGN PATENT DOCUMENTS

| | | | |
|---|---|---|---|
| 155963 | 1/1964 | U.S.S.R. | 350/61 |

*Primary Examiner*—B. A. Reynolds
*Assistant Examiner*—M. H. Paschall
*Attorney, Agent, or Firm*—Spencer & Kaye

[57] ABSTRACT

A heat-cooking apparatus such as an electronic oven of the type having an oven cavity, a heat source, an infrared detecting equipment adapted to detect the rate of radiation of the infrared rays from the surface of the material under cooking and a controller for controlling the heat source in accordance with the output from the infrared detecting equipment. The infrared detecting equipment includes a reflective plate and a shield cylinder which in combination ensure highly efficient and accurate detection of infrared rays over a long period of time.

20 Claims, 16 Drawing Figures

HEAT-COOKING APPARATUS INCORPORATING INFRARED DETECTING SYSTEM

BACKGROUND OF THE INVENTION

The present invention relates to a heat-cooking apparatus incorporating an infrared detecting system.

In a heat-cooking apparatus such as an electronic oven, it is highly desirable to automatically control the heat source in accordance with information concerning the progress of the cooking thereby automatically achieving good cooking.

To this end, there have been proposed and used various types of controllers for heat-cooking apparatuses. For instance, it has been attempted to detect the temperature of the heat-cooked material directly by inserting a temperature sensor into the material. It has been also proposed to control the heat source by detection of the temperature or humidity of the atmosphere within the oven cavity which changes as vapor is generated from the material being cooked.

The use of a temperature sensor insertable into the material being cooked permits direct detection of the temperature but on the other hand poses various problems as follows. Namely, this type of sensor can provide the temperature information of only a specific portion of the material where the sensor is inserted. In addition, this sensor cannot be used in the defreezing of material to be cooked because it cannot be inserted into hard frozen material.

The control device relying upon the detection of temperature or humidity of the atmosphere in the oven cavity also poses various problems such as indirect and, hence, inacurate detection of the temperature of the material being cooked which causes a large fluctuation in the quality of cooking particularly in the case of short-time cooking and so forth.

Thus, the control devices heretofore proposed are still unsatisfactory in that they cannot fully meet the demand for good and automatic cooking with heat-cooking apparatus.

On the other hand, the current progress of technology has accomplished a remarkable improvement in the material and processes for producing sensors including infrared sensor. The infrared sensor is a kind of non-contacting type sensors which makes use of the natural phenomenon that a body having a temperature above absolute zero (0° K.) radiates infrared energy from its surface at a rate which is related to the temperature thereof.

Partly because of the demand for better automatic cooking, and partly because of above-explained development of non-contacting type sensors, particularly the infrared sensors, it has become possible to apply the infrared sensor to various machines and equipment for daily life, e.g. the heat-cooking apparatus.

In applying the infrared sensor to heatcooking apparatus, it is necessary that the sensor operate with low infrared energy corresponding to a temperature ranging between −20° to −10° C. the temperature of frozen foodstuffs) and 120° to 180° C. the temperature at which foodstuffs are slightly burnt or scorched). For reference, the intensity I of infrared rays is proportional to $\mu \times T^4$, where $\mu$ and T represent, respectively, the radiation rate and the absolute temperature of the object. In addition, there is a problem of induction noise and noise caused by microwave radiation from the heat source (heater or high-frequency wave generator) of the heat-cooking apparatus. Although the wave treated by the infrared sensor has a relatively large wavelength of the range from several to several tens of microns ($\mu$m), the infrared sensor inevitably makes use of an optic system. Thus, there also is a problem concerning contamination of the optical system.

SUMMARY OF THE INVENTION

It is, therefore, a first object of the invention to provide a heat-cooking apparatus having an infrared sensor for sensing the absolute temperature of the material being cooked to enable the heat-cooking apparatus to effect good automatic cooking.

A second object of the invention is to provide an infrared detecting system having an infrared sensor capable of efficiently and accurately detecting the infrared energy radiated from the material under cooking.

A third object of the invention is to provide an infrared detecting system in which contamination of the optic system for detecting the infrared ray by fragments of cooked material or vapor is avoided to preserve a high and efficient detection of the infrared energy.

A fourth object of the invention is to provide an infrared detecting system having a protecting or shielding function against noises generated by the heat source.

To these ends, according to the invention, there is provided a heat-cooking apparatus having an infrared detecting equipment, including an oven cavity adapted to accommodate a material to be cooked, a heat source for heating the material accommodated by the oven cavity, an infrared sensor adapted to produce a signal proportional to the rate of the infrared rays applied thereto, an infrared detecting optic system for introducing the infrared rays radiated from the material to the infrared sensor and an infrared detecting circuit system adapted to convert the output of the infrared sensor into a desired electric signal; and a controller for controlling the heat source in accordance with the output of the infrared detecting equipment; characterized in that the infrared detecting optic system includes a peephole through which the infrared rays radiated from the material are taken out of the oven cavity, the peephole being formed in one of the walls defining the oven cavity; a reflective plate positioned opposite the oven cavity across the peephole; and a shield cylinder adapted to introduce the infrared rays reflected by the reflective plate into the infrared sensor.

BRIEF DESCRIPTION OF THE DRAWINGS

FIG. 13*b* is a sectional view taken along the line XIIIb—XIIIb of FIG. 13*a.

DESCRIPTION OF THE PREFERRED EMBODIMENTS

According to the present invention, an infrared sensor sensitive to the rate of radiation of infrared rays from material being cooked is applied to a heat-cooking apparatus.

Figure 1:
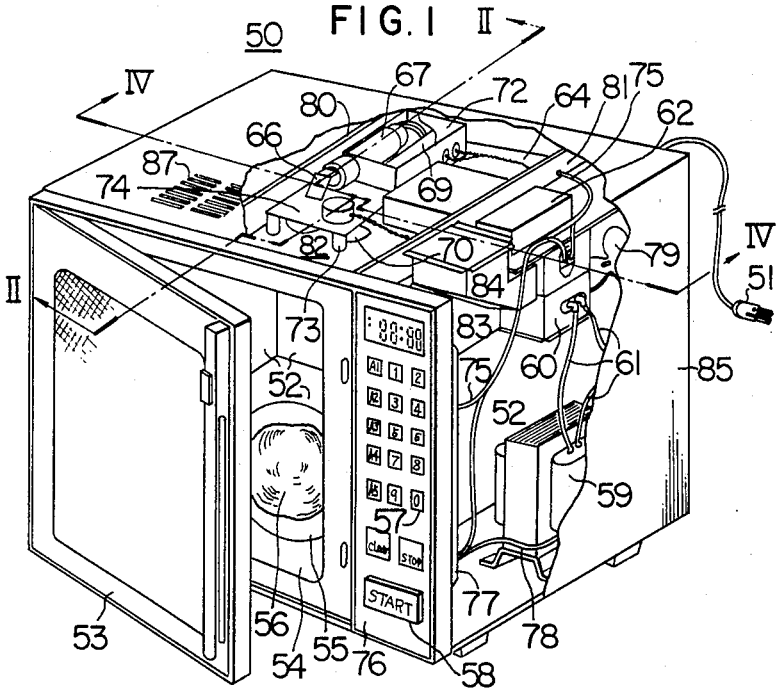
FIG. 1 is a partially cutaway diagram of an electronic oven incorporating an infrared detecting system of the invention.

FIG. 1 is a partly cutaway perspective diagram of an electronic oven 50 incorporating an infrared sensor of the invention having a construction described hereinunder. The manner of using and the operation of this electronic oven are as follows. At first, a power supply cord 51 is fitted to a power supply receptacle. Then, a cooking tray 55 mounting thereon a material 56 to be cooked is placed in an oven cavity 54 defined by walls 52, 64 and a door 53. After closing the door 53, the desired cooking data are entered by means of a cook input button 57 arranged on a control panel 76. Then, by depression of a cook start button 58, high voltage generated in a high voltage transformer 59 is applied through lead wires 61 to a magnetron 60 to energize the latter. High power microwave energy, which is the output from magnetron 60, is propagated through a wave guide 62 for radiation into the oven cavity 54 thereby exciting the oven cavity 54.

During this excitation, the material 56 being cooked is gradually heated so that the rate of radiation of the infrared rays 63 from the surface of the cooking material 56 is increased as the time lapses. The rate of infrared radiation from the cooking material 56, however, is kept substantially constant when the material 56 is being melted, as in the case of the heating of a frozen foodstuff. The infrared rays 63 radiated from the surface of the cooked material is detected by the aforementioned infrared detecting equipment.

More specifically, the infrared detecting equipment is constituted by a peephole 65 (See FIG. 2) formed substantially in the center of the upper wall 64 of the oven cavity, a reflective plate 66 disposed above the peephole 65, a shield cylinder 67, an infrared sensor 68 an infrared detecting circuit system 69 (see FIG. 1) adapted to transform the output from the sensor 68 into a desired electric signal, a chopper 70 made of an electrically insulating material such as ABS resin and adapted to interrupt the infrared rays applied to the infrared sensor 68, and a chopper driving motor 71. A part of the shield cylinder 67, together with the infrared sensor 68 and the infrared detecting circuit system 69 are disposed in a magnetic shield case 72 so as to be shielded against the induction noise produced by the heat source such as a heater or a magnetron.

As will be seen from FIG. 1, the reflective plate 66, the shield cylinder 67, the magnetic shield case 72 and the chopper driving motor 71 are mounted on a plate 74 which in turn is supported by supports 73. The output signal from the infrared detecting equipment is delivered through lead wires 75 to a controller 77 constructed on the back side of the control panel 76 for controlling the oscillation power of the magnetron which is the heat source. The controller 77 then compares the received output from the infrared detecting equipment with the cooking data beforehand set therein, and delivers a control signal to the heat source through lead wires 78 thereby automatically effecting good cooking.

During operation of the magnetron 60, a blower 79 effectively cools the latter. During this cooling, a part of the cooling air for cooling the magnetron 60 is introduced through an air guide 83 into the oven cavity 54 and also into a space 82 defined by the upper wall 64 of the oven cavity, two partition walls 80, 81 and by an outer panel 85, while the remainder of the cooling air is discharged, after cooling the magnetron 60, to the outside of the outer panel 85 through an air guide 84.

The vapor generated by the material 56 being cooked is discharged to the outside of the outer panel 85, being suspended by a part of the cooling air introduced into the oven cavity, through a ventilator 86 (See FIG. 4) formed in the upper wall of the oven cavity and then through an air vent 87 formed in the outer panel 85.

The infrared sensor 68 used in the embodiment shown in FIG. 1 is a focussing type infrared sensor incorporating in its core a sensing element made of LiTaO, $PbTiO_3$, $PVF_2$ or the like adapted to produce an output corresponding to a change in the amount of received infrared rays. It is therefore necessary to use a chopper 70 as an interrupter adapted to interrupt intermittently the incidence of the infrared rays radiated from the cooked material. The chopper and the chopper driving motor can be eliminated if the infrared sensor used is a heat accumulation type infrared sensor incorporating in its core a thin films of Ni and Ni-Cr alloy.

Figure 2:
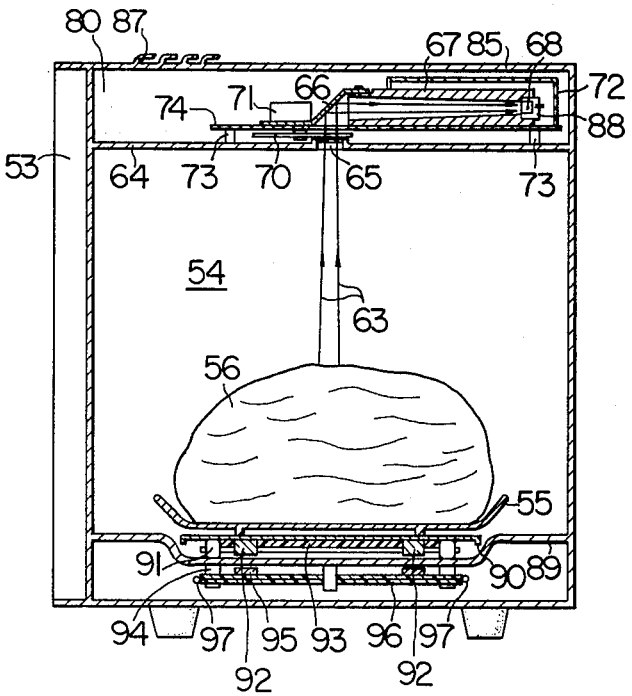
FIG. 2 is a sectional view taken along the line II—II of FIG. 1.

FIG. 2 is a sectional view taken along the line II—II of FIG. 1, in which the same reference numerals are used to denote the same parts or members as those in FIG. 1.

An explanation will be made hereinafter as to how the infrared rays 63 radiated from the surface of the cooked material 56 are applied to the infrared sensor 68. The infrared rays 63 radiated from the surface of the cooking material accommodated in the oven cavity 54 are made to pass through the peephole 65 formed substantially in the center of the upper wall 64 of the oven cavity. During the period in which the chopper 70 does not interrupts the infrared rays, the infrared rays 63 taken out of the peephole 65 are reflected by means of a reflective plate 66 which is attached at an angle of about 45° to the upper wall 64 of the oven cavity, into the shield cylinder 67 which extends substantially in parallel with the upper wall 64 of the oven cavity 64 so as to be applied to the infrared sensor 68 which is placed substantially at the center of the shield cylinder 67 and supported by means of the sensor holder 88.

Since the object of detection of the infrared rays is a foodstuff, various contaminants such as vapor which would adversely affect the infrared detection are produced in the course of the heating. If the infrared sensor 68 is placed so as to face the cooked material 56 across the peephole 65, the incident surface of the sensor will be contaminated thereby deteriorating the precision of the infrared detection. In the worst case, detection will stop. It is possible to place between the peephole and the infrared sensor a member such as a glass plate capable of transmitting the infrared rays to prevent the sensor from being contaminated by the vapor or the like. This, however, is not satisfactory because the member itself is soon contaminated.

Under these circumstances, the present invention provides an arrangement whereby the infrared sensor and the cooking material which is the object of the infrared detection and also the contamination source do not oppose each other directly across the peephole. Namely, according to the invention, the infrared rays radiated from the surface of the cooked material are received by the infrared sensor via the reflective plate 66 which reflects the infrared rays and which can easily be provided with the function of protecting the detector against contamination.

During operation, a significant convection of air takes place around the shield cylinder, due to forced convection of the generated by the blower for cooling the heat source and the natural convection attributable to the generation of vapor from the cooking material as a result of heating. These convections of air naturally bring the contaminants into the shield cylinder to contaminate the infrared sensor. The degree of contamination is much less than that observed in the arrangement in which the cooking material and the infrared sensor are positioned opposite each other directly across the peephole. A test was conducted to examine the durability of the infrared sensor. The test result showed that a shield cylinder having a length of 150 mm can reduce the degree of contamination almost to half of that observed when a shield cylinder 75 mm long is used. This teaches that a certain limitation on the length of the shield cylinder is necessary to ensure high precision infrared detection.

In other words, the length of the shield cylinder 67 plays a role in protecting the infrared sensor against contamination. By employing a certain length, e.g. 150 mm, in addition to the role of shielding the infrared sensor from infrared rays radiated from objects other than the material 56 being cooking, the shielding effect is ensured by limiting the diameter of the opening of the shield cylinder.

The sensor holder 88 integral with the infrared sensor 68 shields the end of the shield cylinder 67 so as to prevent the convection of air into the shield cylinder 67.

During the period in which the infrared rays 63 are interrupted by the chopper 70, the infrared rays radiated from the surface of the chopper 70 are received by the infrared sensor 68. Meanwhile, the material 56 being cooked is rotated by a turntable using magnets which are disposed on the under side of the oven cavity bottom wall 89. Therefore, the region of detection of infrared rays on the surface of the material being cooked 56 is changed gradually as the latter is rotated. This is because the material 56 under cooking is not always positioned symmetrically with respect to the axis of rotation of the turntable 90. However, as a matter of fact, the material 56 to be cooked is normally positioned almost at the center of the turntable 90, because the user in most cases desires to make efficient use of the space in the oven cavity 54. Taking this fact into account, the peephole 65 is formed substantially in the center of the upper wall 64 of the oven cavity, i.e. in the position corresponding to the axis of rotation of the turntable, in order to pick up the infrared rays most efficiently and effectively.

The turntable using magnets is constituted by rollers 91 placed in a recess formed in the oven cavity bottom wall 89, a pulley 93 supporting the turntable 90 and having magnets 92, a pulley 96 disposed beneath the oven cavity bottom wall 89 and opposing the pulley 93 across the latter and having rollers 94 and magnets 95, and a belt 97 for transmitting driving power to the pulley 96.

Figure 3:
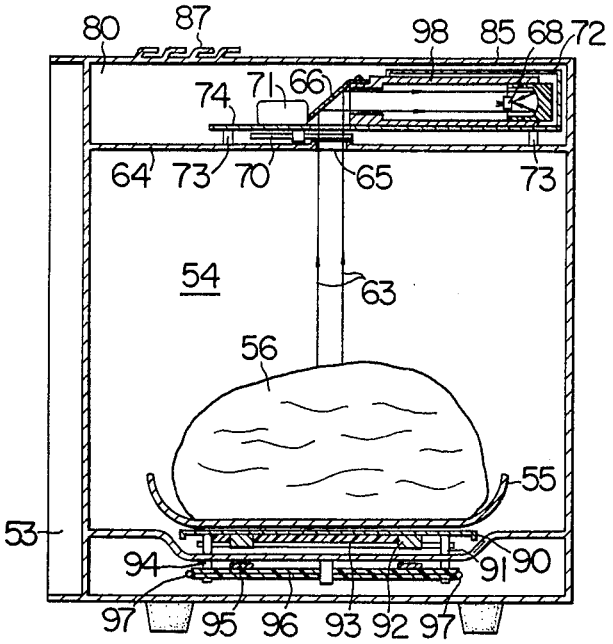
FIG. 3 is a sectional view similar to that in FIG. 2, of another embodiment of the invention.
Figure 5A:
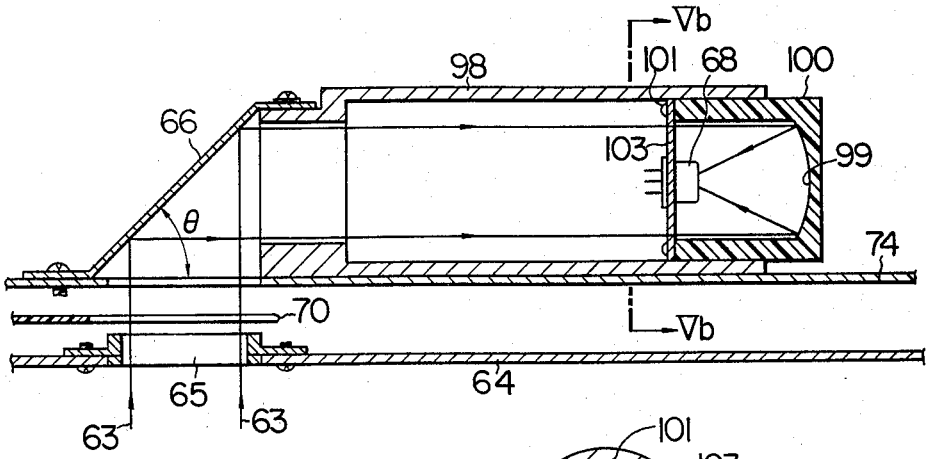
FIG. 5*a* is an enlarged sectional view of the infrared detecting system shown in FIG. 3.
Figure 5B:
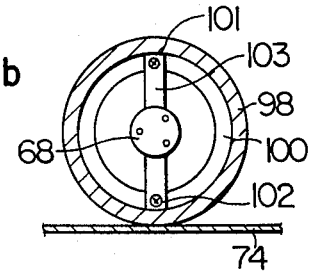
FIG. 5*b* is a sectional view taken along the line Vb—Vb of FIG. 5*a;*

Referring now to FIG. 3 which is a sectional view similar to that in FIG. 2 but showing another embodiment of the invention, as well as to FIGS. 5*a* and 5*b* which are enlarged views of an infrared detecting optic system incorporated in the embodiment shown in FIG. 3, the infrared rays 63 radiated from the surface of the cooking material 56 are picked up through the peephole 65 formed substantially in the center of the upper wall 64 of the oven cavity, and are reflected, when not interrupted by the chopper 70, by the reflective plate 66 which is mounted at an angle $\theta$ which is around 45° to the oven cavity upper wall 64, i.e. to the base 74. The reflected infrared rays are then guided to the shield cylinder 98. At the end portion of the shield cylinder 98, there is mounted a gathering mirror 100 in the form of a parabolic reflector 99. The gathering mirror has a plastic member presenting a parabolic inner surface to which is applied a sheet of a metal such as tin plate, polished aluminum or the like having a high reflection factor to infrared rays. The infrared sensor 68 is positioned at the focus of the parabolic mirror 99, so that the infrared rays are input to the sensor 68 at a high concentration. The restriction provided at the outer end of the shield cylinder 98 is intended for excluding as much as possible the noisy infrared rays radiated from object other than the material 56 being cooked.

The infrared sensor is supported by a sensor support 103 which is fixed at both ends to the gathering mirror 100 by means of screws 101, 102, such that the incident surface of the infrared sensor 68 is positioned at the focus of the parabolic mirror 99.

The infrared detecting equipment of this embodiment can efficiently detect the rate of radiation of the infrared rays from the surface of the material 56 being cooked, in spite of its comparatively simple construction.

A description will be given hereinunder as to the means for protecting the infrared detecting equipment from the contaminants produced by the material 56 under cooking, as well as means for shielding the same against the induction noise produced by the heat source.

Figure 4:
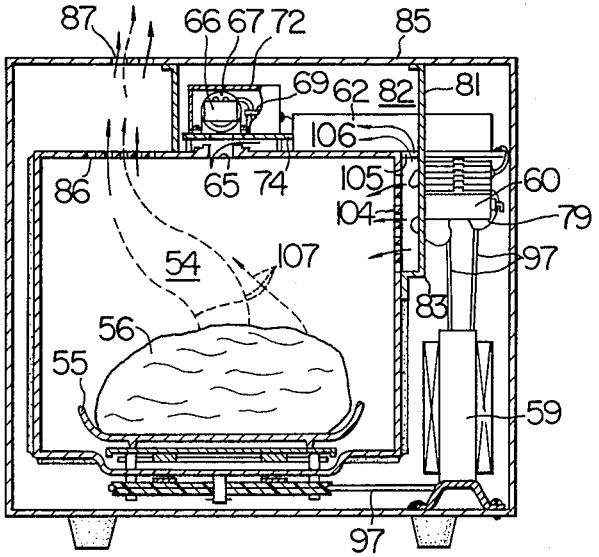
FIG. 4 is a vertical sectional view taken along the line IV—IV of FIG. 1.

Referring now to FIG. 4 which is a sectional view of the electronic oven 50 taken along the line IV—IV of FIG. 1, there is shown the flow of the cooking air in the area around the oven cavity 54. As stated before, a part of the cooking air flow generated by the blower 79 is introduced to the magnetron 60 to cool the latter, while the remainder of the cooling air flow is divided into two sub-flows: one is guided by the air guide 83 into the oven cavity 54 through the air vent 104, while the other is introduced through the air vent 105 into the space 82 defined by the upper wall 64 of the oven cavity, two partition walls 80, 81 and the outer panel 85.

According to this arrangement, the air flow 106 introduced into the space 82 is forcibly made to flow into the oven cavity 54 through the peephole 65. It is remarkable that this flow of air effectively expels the vapor 107 (shown by the interrupted line), which is generated from the material 56 in the course of cooking, through the ventilator 86 formed in the upper wall 64 of the oven cavity 64 and then discharges the same to the outside of the apparatus through the air vent 87.

Figure 6:
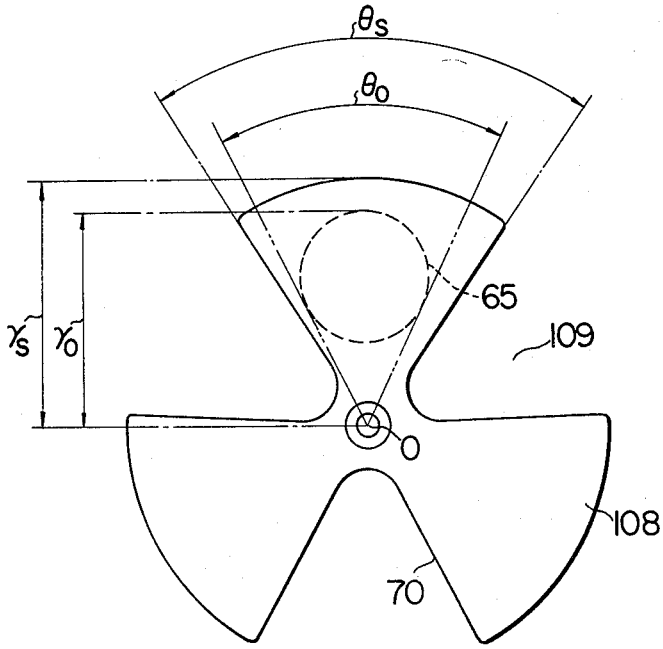
FIG. 6 shows a peephole and a chopper in an embodiment of the invention, in relation to each other.
Figure 7:
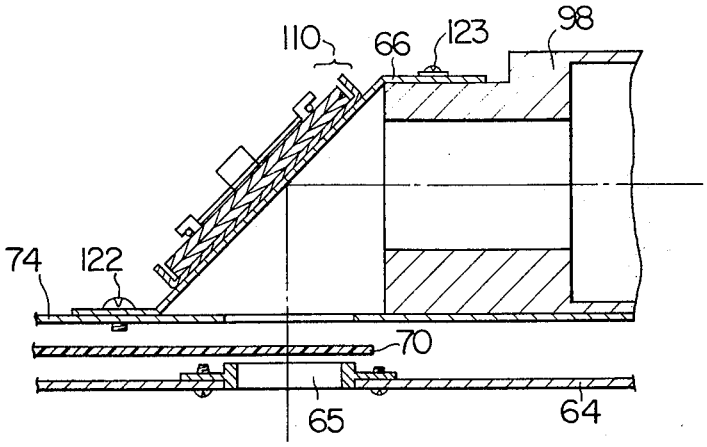
FIG. 7 is an enlarged sectional view of a part of an infrared detecting system having a heater for heating a reflective plate.

FIG. 6 shows how the peephole 65 and the chopper 70 are positioned relative to each other. For convenience, it is assumed here that the chopper 70 has a blade portions 108 and blade-less portions 109. It is also assumed that the axis of rotation of the chopper 70 is positioned at the center 0. Namely, the chopper 70 has a form which is symmetrical with respect to the center 0. Each of the blade portions 108 is so sized as not to reduce the rate of detection of the infrared rays from the cooking material during the heating period, i.e. to provide correct control of the heat source, and to sufficiently cover the peephole 65. More specifically, the diverging angle $\theta_s$ of the blade portion 108 around the center 0 is greater than the angle $\theta_o$ formed around the center 0 between two lines which are tangent to the peephole 65. In addition, the radial length $\gamma_s$ between the center 0 and the radially outer end of the blade portion 108 is greater than the maximum radial length $\gamma_o$ between the center 0 and the periphery of the peephole 65. Also, the blade-less portion 109 is large enough to accommodate the entire peephole 65.

It is possible to protect the infrared detecting optic system against contaminants such as vapor from fragments of the cooked material which are produced in the course of heating due to evaporation or puncture of the material which would adversely affect the optic system by passing through the peephole 65.

The peephole 65 has a diameter which is much smaller than the wavelength of the microwaves which excite the space inside the heating oven. In order to obtain a heat-cooking apparatus having a compact construction, however, it is necessary to position the chopper 70 in close proximity with the peephole 65. It has proved been through an experiment that the use of a chopper made of metal causes an induction noise in the infrared detecting circuit system when the chopper 70 is placed in close proximity with the peephole 65. It has also been proved that the undesirable induction noise can be eliminated by using an electrically insulating material such as ABS resin as the chopper material, even when the latter is positioned in close proximity to the peephole 65. In the described embodiment, therefore, the chopper 70 is constituted by an electrically insulating material.

FIGS. 7 to 10 in combination show means for heating the reflective plate 66. As stated before, protecting means are provided for protecting the infrared detecting optic system against various contaminants. In addition to such protecting means, the reflecting plate 66 is provided with a heating element 110 for preventing the dewing of vapor on the infrared reflecting surface thereby maintaining the high reflection factor of the reflective plate 66.

Figure 9:
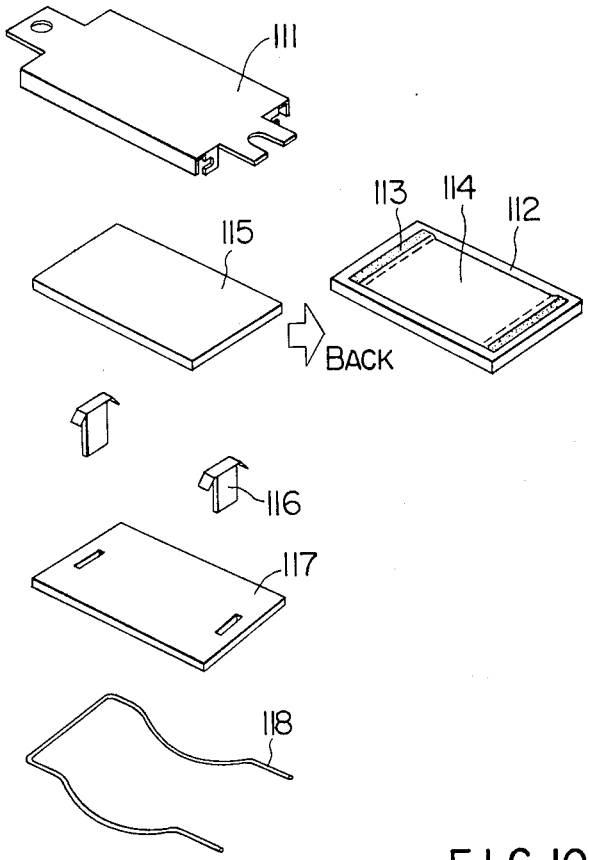
FIG. 9 is an exploded view of the heater element shown in FIG. 8.
Figure 10:
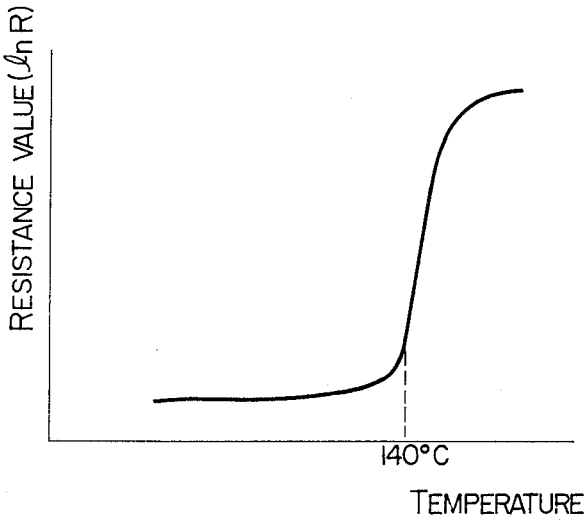
FIG. 10 is a PTC characteristic diagram drawn for the heater element of an embodiment of the invention.

The heater element 110 for the reflective plate is a temperature self-controlled heater element having a positive temperature coefficient as shown in FIG. 10. More specifically, the heating element 110 is constituted by a heater 115 which includes, as shown in FIG. 9, a radiator 111, a base 112, silver electrodes 113 and a resistor 114. The heater element 110 further has electrode terminals 116, a holder plate 117, and a hold spring 118.

Figure 8:
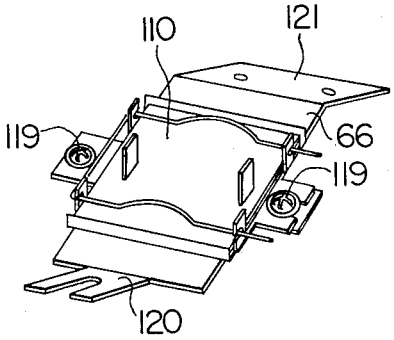
FIG. 8 is a perspective diagram of a reflective plate and a heater element for heating the reflective plate of an embodiment of the invention.

The heater element 110 is fastened by means of screws 119 as shown in FIG. 8 such that the radiator 111 is held in the close contact with the back surface of the reflective plate 66 which is made of a material having a high reflection factor to infrared rays, e.g. a polished Al-plate with a finely polished reflecting surface, a tin plate sheet iron or the like. The reflective plate 66 has flanges 120, 121 which are adapted to be secured to the base 74 and the shield cylinder 98, respectively, by means of screws 122, 123, so that the reflective plate 66 carrying the heater element 110 is firmly fixed at about a 45° inclination.

As the cooking proceeds and the temperature of the material 56 under cooking is raised, the material begins to release vapor. Also, fats as well as fragments of the material 56 begin to be scattered as a result of puncture of the latter. The vapor, fat and the fragments of the material have a tendency to come through the peephole 65 into the infrared detecting optic system to seriously contaminate the latter. Therefore, it is preferred to provide a suitable protective function for keeping the infrared detecting system away from such contaminants.

FIGS. 11 to 14 in combination show peephole shielding means as examples of means for performing such a protective function.

Figure 11:
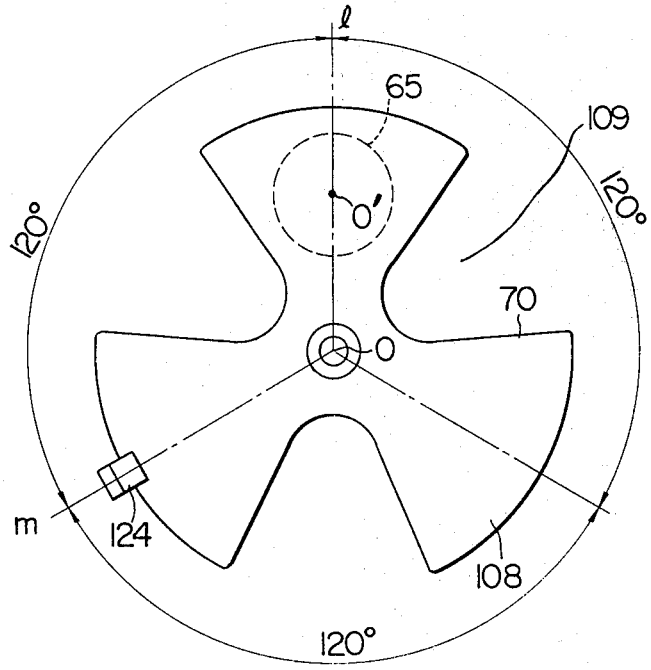
FIG. 11 shows how a peephole, chopper and a chopper position detector are related to one another in an embodiment of the invention.
Figure 12:
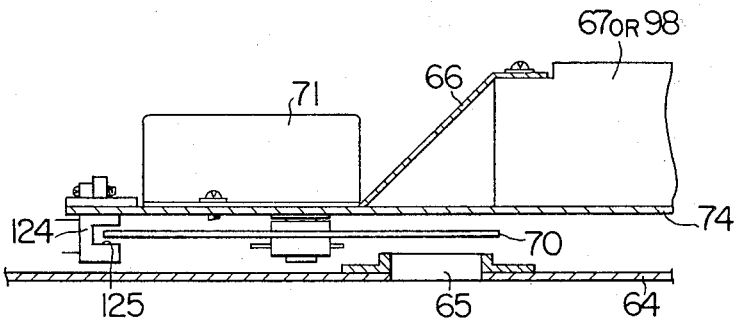
FIG. 12 is an enlarged view of a part of an infrared detecting system embodying the invention, having a chopper position detector.
Figure 14:
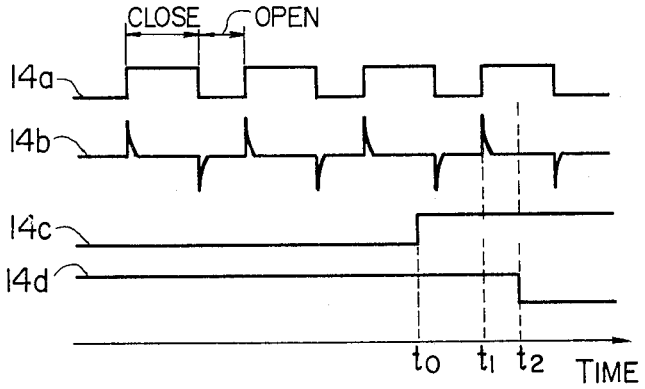
* and FIG. 14 is a time chart for explaining the operation of the chopper shown in FIG. 11.

FIGS. 11 and 12 show an example in which the peephole shielding means for shielding the peephole 65 are constituted by the chopper 70. The timing of opening and closing of the peephole 65 by the chopper 70, i.e. the rotational position of the chopper 70, is detected by a detector 124 for detecting the rotational position of the chopper 70. The detector 124 for detecting the rotational position of the chopper 70 is so located that a line m, which is rotated 120° from a reference line l connecting the center 0 of rotation of the chopper 70 and the center 0' of the peephole 65, passes almost through the center of the detector 124. The operation of the detector 124 will be described hereinafter with specific reference to FIG. 14 showing a time chart of the operation.

The detector 124 for detecting the rotational position of the chopper 70 is constituted by a photo-interrupter which has, as shown in FIG. 12, a slit or recess 125 adapted to receive the blade portion of the chopper 70. The peephole 65 is closed and opened, respectively, by a blade portion of the chopper 70 when the preceding blade portion of the same is received in or out of the slit 125 of the detector 124. The detector 124 produces a series of rectangular pulses as denoted by a numeral **14*a* depending on the closed and opened state of the peephole 65. Signals as denoted by a numeral 14*b* are obtained by differentiating the rectangular pulses 14*a***.

The controller 77 as shown in FIG. 1 makes a comparison between the output signal of the infrared detecting equipment and the previously set reference signal which corresponds to the temperature at which the material 56 under cooking starts to release vapor. As the level of the output signal of the infrared detecting equipment becomes higher than the level of the reference signal, the controller 77 produces a stop signal **14*c* for stopping the rotation of the chopper 70**.

After generation of the stop signal at a moment $t_o$, the first or earliest differentiated positive pulse, i.e. the pulse generated at a moment $t_1$, is detected. Upon detection of this pulse, as shown with reference numeral **14*d*, the controller 77 acts to cut the power supply to the chopper driving motor 71 at a moment $t_2$ when a blade portion of the chopper completely covers the peephole 65. In order to control, as much as possible, the rotation of the chopper 70 by inertia after the cutting of the power supply to the chopper driving motor 71, a stepping motor or an inductor type synchronous motor, which permits relatively easy control of rotation by inertia, is used as the chopper driving motor 71. In addition, the angular difference between $\theta_o$ and $\theta_s$ as explained before in connection with FIG. 6 effectively compensates for a slight deviation of stopping position of the chopper from the aimed stopping position. Also, the difference between the radial lengths $\gamma_o$ and $\gamma_s$ as explained before in connection with FIG. 6 effectively prevents the contamination of the radially outer end portions of the blade portions which are to be received by the restricted slit 125 of the detector 124**.

Figure 13A:
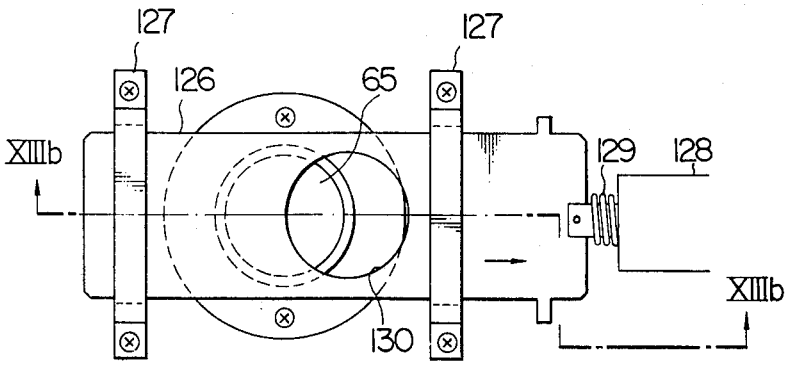
FIG. 13*a* is a top plan view of a peephole shielding device incorporated in another embodiment of the invention.
Figure 13B:
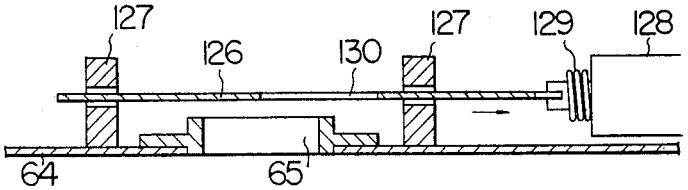

FIGS. 13*a* and 13*b* in combination show another example in which a board 126 is used as the shield means for the peephole 65. The board 126 is supported by a supporter 127 and has a window 130 formed therein. This shield means operates in a manner described hereinunder. When the level of the output signal of the infrared detecting equipment is below the level of the previously set reference signal corresponding to the temperature at which the cooking material 56 starts to release vapor, a solenoid 128 is deenergized so that the board 126 is pushed by a spring 129 to such a position that the window 130 is positioned above the peephole 65 to fully open the latter. However, as the detection output level is raised above the level of the reference signal, the solenoid 128 is energized to attract the board 126 in the direction of the arrow, overcoming the force of the spring 129.

As a result, the window 130 is moved out of the position aligning the peephole 65, and the latter is completely closed by the board 126.

Although the invention has been described through its specific forms, the described embodiments are not exclusive and various changes and modifications can be imparted thereto without departing from the scope of the invention which is limited solely by the appended claims.

What is claimed is:

1. In a heat-cooking apparatus including an oven cavity adapted to accommodate the material to be cooked, a heat source for heating said material accommodated by said oven cavity, an infrared sensor adapted to produce a signal proportional to the rate at which infrared rays are applied thereto, an infrared detecting optic system for introducing the infrared rays radiated from said material to said infrared sensor, an infrared detecting circuit system adapted to convert the output of said infrared sensor into an electric signal, and a controller for controlling said heat source in accordance with the output of said infrared detecting equipment, the improvement wherein said infrared detecting optic system includes a peephole through which the infrared rays radiated from said material emerge from said oven cavity, said peephole being formed in one of the walls defining said oven cavity; a stationary reflective plate having a reflective surface facing said oven cavity through said peephole; an elongated shield cylinder having an opening for introducing the infrared rays reflected from said stationary reflective plate to said infrared sensor, said shield cylinder having a length and opening size which defines the radiant area from which originate the infrared rays introduced into said infrared sensor and which protects said infrared sensor from contamination; and means for closing said peephole when the level of the output from said infrared detecting equipment is above the level of a previously set reference signal.

2. A heat-cooking apparatus as claimed in claim 1, wherein said infrared detecting optic system further includes a gathering mirror which is disposed in said shield cylinder so as to focus the infrared rays radiated from said material and introduced into said shield cylinder by means of said stationary reflective plate, thereby directing the focused infrared rays to said infrared sensor.

3. A heat-cooking apparatus as claimed in claim 2, wherein said gathering mirror is a parabolic mirror.

4. A heat-cooking apparatus as claimed in claim 2, wherein said gathering mirror comprises a base member made of an electrically insulating material, and a metal having a high reflection factor to infrared rays applied to the surface of said base member.

5. In a heat-cooking apparatus including an oven cavity adapted to accommodate the material to be cooked, a heat source for heating said material accommodated by said oven cavity, an infrared sensor adapted to produce a signal proportional to the rate at which infrared rays are applied thereto, an infrared detecting optic system for introducing said infrared rays radiated from said material to said infrared sensor, an infrared detecting circuit system for converting the output of said infrared sensor into a desired electric signal, and a controller for controlling said heat source in accordance with the output from said infrared detecting equipment, the improvement wherein said infrared detecting optic system includes a peephole through which said infrared rays radiated from said material emerge from said oven cavity, said peephole being formed in one of the walls defining said oven cavity; a stationary reflective plate having a reflective surface facing said oven cavity through said peephole; an elongated shield cylinder having an opening for introducing the infrared rays reflected from said stationary reflective plate to said infrared sensor, said shield cylinder having a length and opening size which defines the radiant area from which originate the infrared rays introduced into said infrared sensor, and which protect said infrared sensor from contamination; a chopper adapted to interrupt intermittently said infrared rays when the level of the output from said infrared detecting equipment is under the level of a previously set reference signal; a chopper driving motor for driving said chopper; a detector for detecting the rotational position of said chopper; and a control means adapted to stop said chopper at a position where one of said blade portions of said chopper closes said peephole when the level of the output from said infrared detecting equipment is above the level of said previously set reference signal.

6. A heat-cooking apparatus as claimed in claim 5, wherein said infrared detecting optic system further includes a gathering mirror which is disposed in said shield cylinder so as to focus said infrared rays radiated from said material and introduced into said shield cylinder by means of said stationary reflective plate, thereby directing the focused infrared rays to said infrared sensor.

7. A heat-cooking apparatus as claimed in claim 6, wherein said gathering mirror is a parabolic mirror.

8. A heat-cooking apparatus as claimed in claim 6, wherein said gathering mirror comprises a base member made of an electrically insulating material, and a metal having a high reflection factor to infrared rays applied to the surface of said base member.

9. A heat-cooking apparatus as claimed in claim 5, wherein the combination of said peephole, chopper, reflective plate, shield cylinder and infrared sensor are arranged in the mentioned order to constitute said infrared detecting optic system.

10. A heat-cooking apparatus as claimed in claim 6, wherein said peephole, chopper, reflective plate, shield cylinder, infrared sensor and gathering mirror are arranged in the mentioned order.

11. A heat-cooking apparatus as claimed in claim 5, wherein said chopper is made of an electrically insulating material.

12. A heat-cooking apparatus as claimed in claim 5, wherein the diverging angle $\theta_s$ of each blade portion of said chopper for interrupting said infrared rays around the center of rotation of said chopper is greater than the sector angle $\theta_o$ formed around said center between two lines tangent to said peephole, and that the radial distance $\gamma_s$ between said center and the radially outer extremity of said blade portion is greater than the maximum radial distance $\gamma_o$ between said center and the periphery of said peephole.

13. A heat-cooking apparatus as claimed in claim 5, wherein said chopper driving motor for driving said chopper is one of a stepping motor and an inductor type synchronous motor.

14. A heat-cooking apparatus as claimed in claim 1 or 5, which further comprises means for heating said reflective plate when the level of the output from said infrared detecting equipment is above the level of said previously set reference signal.

15. A heat-cooking apparatus as claimed in claim 14, wherein said heating means includes a heater element disposed at the back side of said reflective plate, said heater means heating said reflective plate by radiation or conduction of heat.

16. A heat-cooking apparatus as claimed in claim 15, wherein said heater element for heating said reflective plate is a temperature self-controlling thermistor having a positive temperature characteristic.

17. A heat-cooking apparatus as claimed in claim 5, wherein said peephole is formed in the upper wall of said oven cavity substantially at the central portion of said upper wall.

18. A heat-cooking apparatus as claimed in claim 1 or 5, which further comprises an electromagnetic shield box for accommodating said infrared sensor and said infrared detecting circuit system.

19. A heat-cooking apparatus as claimed in claim 1 or 5, which further comprises in combination a blower and an air guide for forcibly feeding air into said oven cavity at least through said peephole.

20. A heat-cooking apparatus as claimed in claim 1, wherein said means for closing said peephole comprises a board and an electromagnetic driving means for selectively moving said board into and out of the position for closing said peephole.

* * * * *